United States Patent [19]

Ward

[11] Patent Number: 5,016,758

[45] Date of Patent: May 21, 1991

[54] SECURITY DEVICE FOR CLOTHING

[76] Inventor: Richard Ward, 529 Poplar St., Lansdale, Pa. 19446

[21] Appl. No.: 522,646

[22] Filed: May 14, 1990

[51] Int. Cl.[5] ..... A47F 5/00

[52] U.S. Cl. ..... 211/4; 70/59; 70/62

[58] Field of Search ..... 211/4, 7; 70/59, 62, 70/58

[56] References Cited

U.S. PATENT DOCUMENTS

| | | | |
|---|---|---|---|
| 3,378,144 | 4/1968 | Webster | 211/4 |
| 3,647,072 | 3/1972 | Strang | 211/4 |
| 4,069,919 | 1/1978 | Fernbaugh | 70/62 |
| 4,073,415 | 2/1978 | Pegg | 70/59 X |
| 4,460,093 | 7/1984 | Otema | 70/59 X |
| 4,540,092 | 9/1985 | DeSantis | 70/59 X |
| 4,885,920 | 12/1989 | Larson | 211/7 X |

*Primary Examiner*—Robert W. Gibson, Jr.
*Attorney, Agent, or Firm*—Z. T. Wobensmith, III

[57] ABSTRACT

A security device for clothing wherein a strong flexible cable is fastened at one end to a lock, carried on a hanger, or to a bar on a clothing stand, which cable passes through part of a garment such as a sleeve and the other end of the cable is detachably secured in the lock to releasably secure the garment.

1 Claim, 2 Drawing Sheets

SECURITY DEVICE FOR CLOTHING

BACKGROUND OF THE INVENTION

1. Field of the Invention

This invention relates to a security device for clothing while stored on a rack and is of the type that has a cable that passes through a portion of the garment and is releasably connected to a lock.

2. Description of the Prior Art

Theft of clothing is at an all time high in the United States. Storekeepers have to display clothing articles to that customers can examine them and ultimately try them on. The most common currently available devices rely upon a cable that is threaded through all the garments on a rack or floor stand and connected at each end. To get to garments in the middle of the rack, the cable must be disengaged from all the garments until the desired one is reached and then removed. The cable is then threaded through the remaining garments and secured. If the customer returns the garment the cable must be disengaged, the returned garment properly located on the rack, and the cable resecured. This is a an awkward and time consuming process and makes it even more difficult for salespersons, who must deal with multiple customers and garments at the same time.

Various anti-theft devices have been proposed such as is shown in the U.S. patents to L. S. Fleck et al U.S. Pat. No. 3,568,479, Fernbaugh U.S. Pat. No. 3,985,183, Pegg U.S. Pat. No. 4,073,415, Bennett et al U.S. Pat. No. 4,260,063, Thomas U.S. Pat. No. 4,336,885, Otema U.S. Pat. No. 4,573,584, pl and Jamison U.S. Pat. No. 4,685,572. None of the structures disclosed in the prior art is satisfactory as they are too expensive, too complicated or not adaptable to existing hangers, racks, or different types of clothing.

The security device of the invention can be used in one embodiment with existing hangers and racks, or in another embodiment can be attached to simply modified racks, and used with existing clothing hangers, permitting removal and replacement of articles of clothing at any location on a rack without disturbing the other articles of clothing on the same rack.

SUMMARY OF THE INVENTION

It has now been found that a security device for clothing that includes a lock that can be secured to any well known hanger or to a bar on a rack, and which has a flexible cable which can pass through a portion of the clothing article and have an end releasably secured in the lock provides an anti-theft device.

The principal object of the invention is to provide a security device for clothing that can be used at any floor stand or rack location and with a wide variety of clothing articles.

A further object of the invention is to provide a security device for clothing that is simple and inexpensive to make but sturdy and reliable in use.

A further object of the invention is to provide a security device for clothing that is easy to use and adaptable to a variety of floor stands or racks.

Other objects and advantageous features of the invention will be apparent from the description and claims.

DESCRIPTION OF THE DRAWINGS

The nature and characteristic features of the invention will be more readily understood from the following description taken in connection with the accompany drawings forming part hereof in which.

Figure 1:
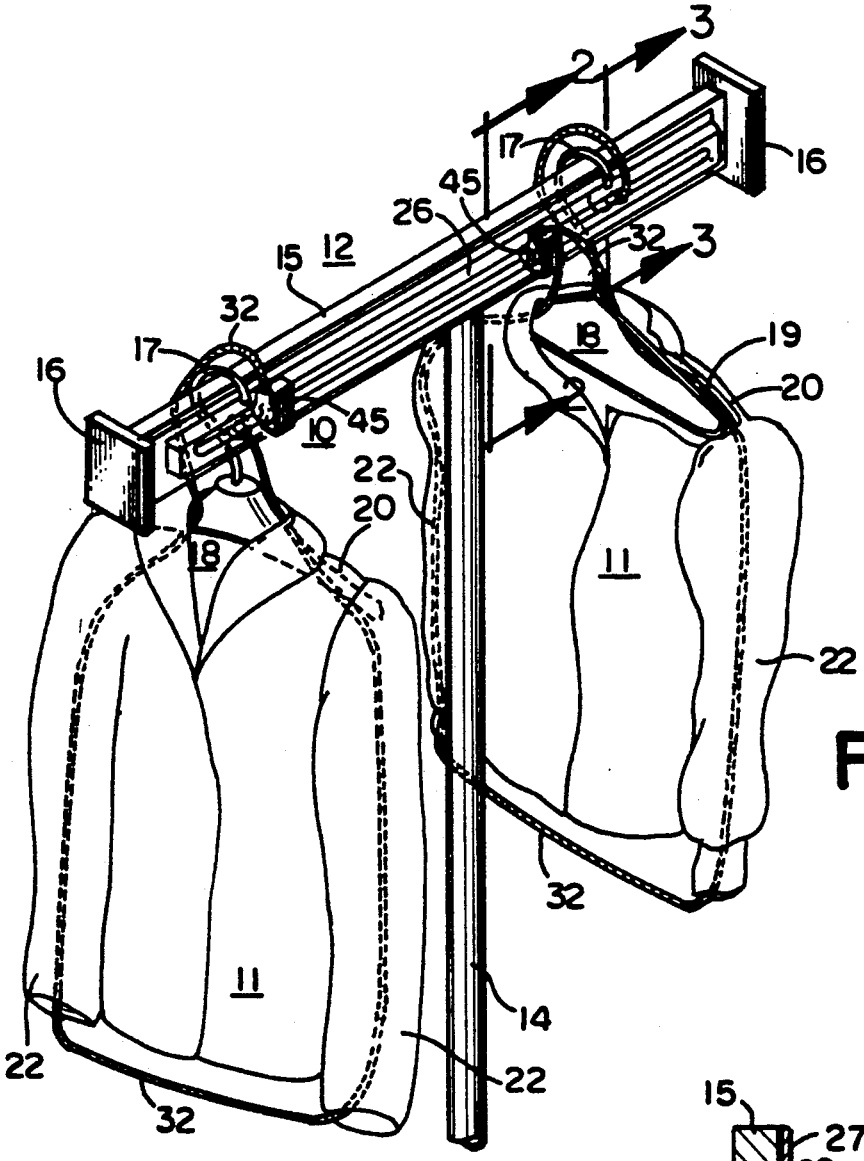
FIG. 1 is a view in perspective of a portion of a clothing rack illustrating one embodiment of security device of the invention.
Figure 2:
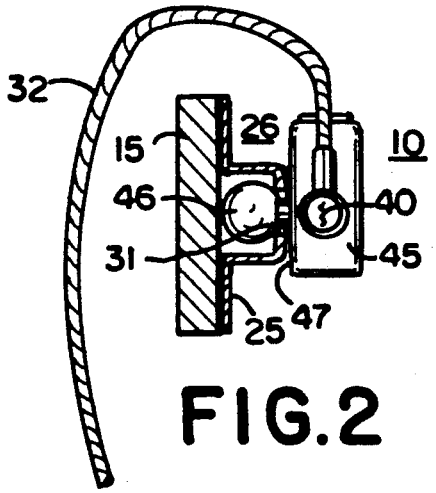
FIG. 2 is a fragmentary, vertical sectional view, enlarged, taken approximately on the line 2—2 of FIG. 1.
Figure 3:
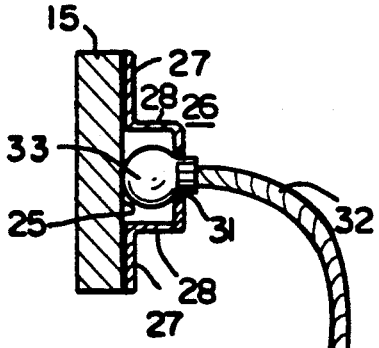
FIG. 3 is a fragmentary, vertical sectional view, enlarged, taken approximately on the line 3—3 of FIG. 1.
Figure 4:
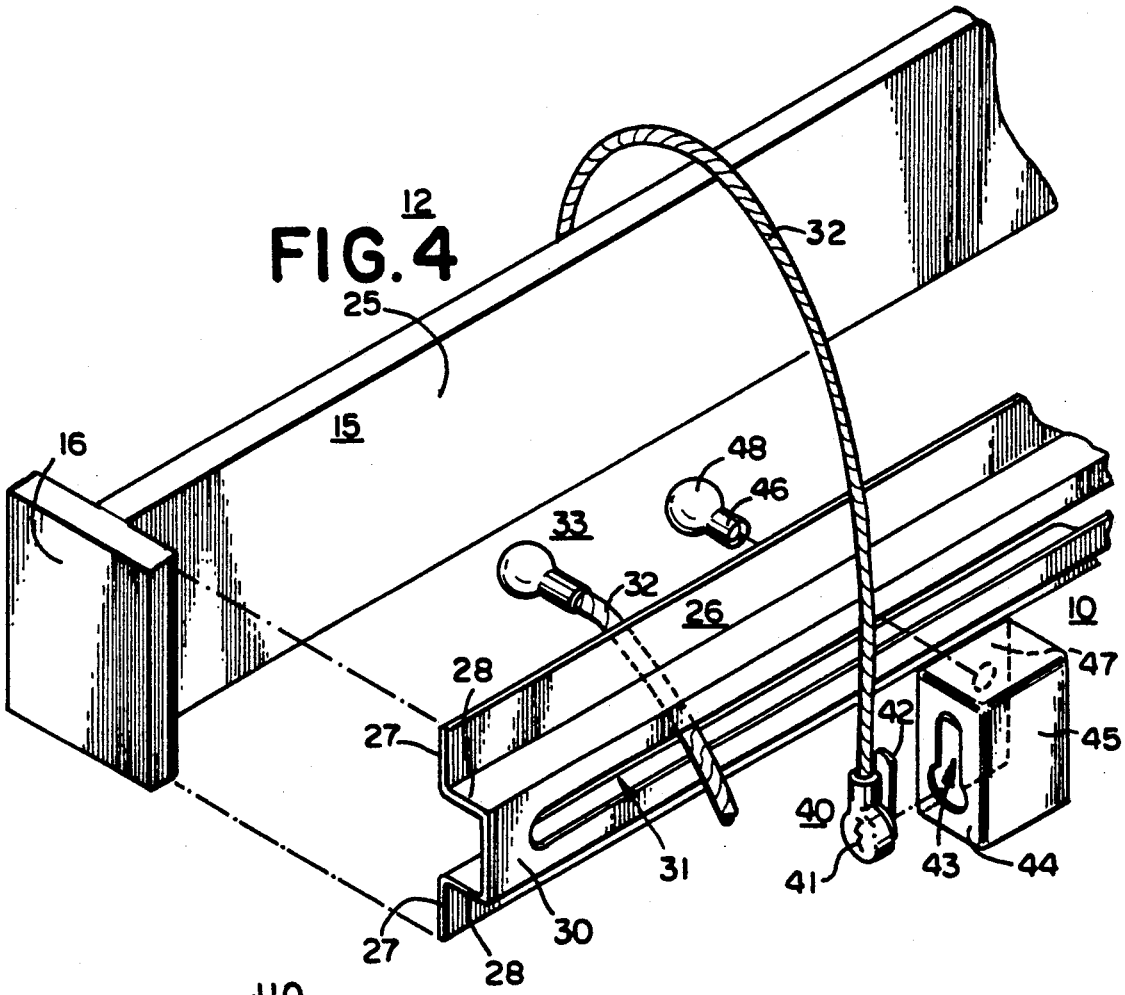
FIG. 4 is a fragmentary, exploded perspective view, further enlarged, of the embodiment of the invention of FIG. 1.

It should, of course, be understood that the description and drawings herein are illustrative merely and that various modifications and changes can be made in the structure disclosed without department from the spirit of the invention.

DESCRIPTION OF THE PREFERRED EMBODIMENTS

Referring now more particularly to the drawings and FIGS. 1 to 4 inclusive one embodiment of security device 10 for securing clothing articles 11 onto a rack 12 is therein illustrated.

The rack 12 includes a vertical post 14, which extends down to a base (not shown), which is on a floor (not shown). The post 14 is preferably of metal and has a rail 15 attached to its uppermost end, in perpendicular relationship. The rail 15 is of rectangular shape in cross section, and provided with vertical plates 16 at each end, to retain hooks 17 from garment hangers 18 from coming off the rail 15, other than by lifting of the hooks 17 off the rail 15. The garment hangers 18 are of conventional type, each with a triangularly shaped body 19 extending from its hook 17 which fits into the shoulders 20 of a clothing article or garment 11 which has sleeves 22.

The garments 11 as illustrated are coats or jackets, but other articles of clothing such as shorts, blouses, t-shirts, sweat shirts, dresses, suits, and other clothing articles can be used with hangers 18.

The rail 15 on its side 25 has a modified u-shaped channel 26 extending therealong, which may be of metal and fastened to rail 15 by welding in well known manner.

The channel 26 has two flat ribs 27 which contact the rail 15 with two plates 28 perpendicular thereto, perpendicular thereto and connected by a face plate 30. The plate 30 has a slot 31 therealong, which has a flexible cable 32 extending therethrough, with a know 33 on its end, of a larger diameter than slot 31, thereby retaining the knob 33 and cable 32 to channel 26, but which is free to move the length of slot 31. Cable 32 is preferably of braided steel strands, which are resistant to cutting, and which cable may be coated with clear plastic (not shown) of well known type to protect from soiling. The cable 32 at its other end has a lock 40 thereon, which has a main body 41 with a shaft (not shown) extending therefrom with a blade 42 thereon. The blade 42 fits into an elongated slot 43 in wall 44 of box 45, and upon rotation secures lock 40 therein. Lock 40 can be key operated in convention manner. The box 45 is of rectangular configuration, with a knob 46 extending from a rear well 47 and through slot 31, with a head 48 of larger diameter than slot 31, so that the knob 46 is retained inside the channel 26.

The box 45 is preferably of metal, and can be moved lengthwise along slot 31.

Figure 6:
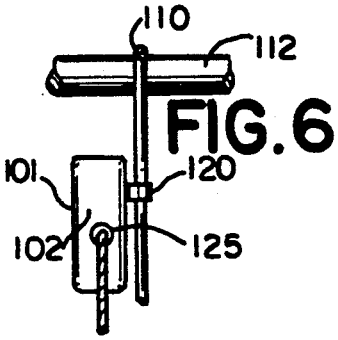
FIG. 6 is a side elevational view of the embodiment of security device of FIG. 5.
Figure 5:
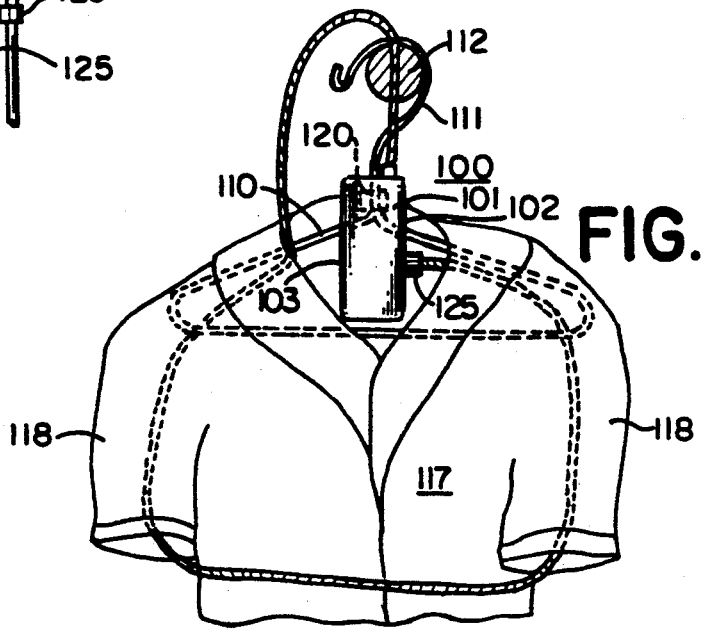
FIG. 5 is a front elevational view of a clothing article, which has another embodiment of security device of the invention attached thereto.

Referring now more particularly to FIGS. 5 and 6 another embodiment of security device for clothing is illustrated, which can be used with existing hangers, and does not require any modification to the clothing rack as does the embodiment of FIGS. 1–4. The device 100 includes a hollow metal box 101 with a front wall 102 rear wall 103, side walls 104 bottom wall 105, and top wall 106. The box 101 is preferably formed of metal such as steel. A hanger 110 of conventional type is illustrated, with a hook 111 to engage a bar 112 from a floor stand or rack (not shown). The hanger 110 has a triangularly shaped main body 115, which fits into the shoulders 116 of a garment 117, which has sleeves 118. The box 101 has a clip 120, rear wall 103 as shown in FIG. 6 which is secured to hook 111. The top wall 106 has one end 121 of a cable 122 secured thereto.

A lock 125 similar to lock 40 is secured to the other end 126 of cable 122. One of the side walls 104 of box 101 has a slot 127 therein similar to slot 43 in box 45, into which a blade (not shown) of lock 125 passes, and upon rotation secures lock 125 to box 101. Lock 125 is key operated in conventional manner.

The mode of operation will now be pointed out.

When it is desired to secured a garment 11 or 117 to hanger 18 or 110 the lock 40 or 125 on cable 32 or 122 is threaded through one or both sleeves 22 or 118 carrying cable 32 or 122 with it, and the lock is inserted into slot 43 or 127 and its blade rotated to secure the lock therein. The lock 40 or 125 can be removed, cable 32 or 122 withdrawn from garment 11 or 117, and the cycle repeated.

It will thus be seen that structure has been provided with which the objects of the invention are attained.

I claim:

1. In combination with a rack for displaying a plurality of clothing articles side by side which rack has a rail onto which garment hangers carrying the clothing articles are individually hung, apparatus to provide security for said garments which comprises a flexible cable for each garment which extends through a portion of the clothing article, said rail has a raised U-shaped channel thereon, a lengthwise slot in said channel, said cable having a know on one end of said cable in said slot and free to move therealong, said cable having a lock at the other end, box means to which said lock is detachably connected, said box means having a knob extending therefrom in said slot retaining said box means to said channel and free to move therealong, so that when said lock is disconnected from said box means said clothing articles can be individually removed and replaced without disturbing adjacent clothing articles.

* * * * *

UNITED STATES PATENT AND TRADEMARK OFFICE

CERTIFICATE OF CORRECTION

PATENT NO. : 5,016,758

DATED : May 21, 1991

INVENTOR(S) : Richard Ward

It is certified that error appears in the above-identified patent and that said Letters Patent is hereby corrected as shown below:

Column 2

Line 21, "department" should be - departing - .

Line 55, "know" should be - knob - .

Column 4

Line 19, "know" should be - knob - .

Signed and Sealed this

Fifteenth Day of September, 1992

*Attest:*

DOUGLAS B. COMER

*Attesting Officer*

*Acting Commissioner of Patents and Trademarks*